US012365513B2

(12) United States Patent
Bivins

(10) Patent No.: US 12,365,513 B2
(45) Date of Patent: Jul. 22, 2025

(54) GAS CYLINDER PALLET

(71) Applicant: Scott Bivins, Ponca City, OK (US)

(72) Inventor: Scott Bivins, Ponca City, OK (US)

( * ) Notice: Subject to any disclaimer, the term of this patent is extended or adjusted under 35 U.S.C. 154(b) by 95 days.

(21) Appl. No.: 18/308,809

(22) Filed: Apr. 28, 2023

(65) Prior Publication Data

US 2023/0348137 A1 Nov. 2, 2023

Related U.S. Application Data

(60) Provisional application No. 63/336,043, filed on Apr. 28, 2022.

(51) Int. Cl.
*B65D 19/44* (2006.01)
*B65D 19/06* (2006.01)

(52) U.S. Cl.
CPC ..... *B65D 19/44* (2013.01); *B65D 19/06* (2013.01); *B65D 2519/00273* (2013.01); *B65D 2519/0082* (2013.01)

(58) Field of Classification Search
CPC ..... B65D 19/44; B65D 19/06; B65D 19/00; B65D 19/00502; B65D 19/00532; B65D 2519/00273; B65D 2519/0082
USPC ..... 108/51.11, 55.1, 55.5, 57.33, 27
See application file for complete search history.

(56) References Cited

U.S. PATENT DOCUMENTS 4,295,431 A * 10/1981 Stavlo ..... F17C 13/084 294/67.1
5,078,415 A * 1/1992 Goral ..... F17C 13/085 414/537
5,533,456 A * 7/1996 Regina ..... B65D 19/385 211/183
7,017,741 B1 * 3/2006 Williamson ..... F17C 13/084 206/386
9,061,822 B2 * 6/2015 Ness ..... B65D 90/54
9,216,841 B1 * 12/2015 Ness ..... B65D 19/08
9,752,726 B2 * 9/2017 Frenal ..... F17C 13/084
9,909,717 B2 * 3/2018 Frenal ..... F17C 13/084
11,136,818 B2 * 10/2021 Zwierzykowski .... E06B 9/0653
2009/0250416 A1 * 10/2009 Chookang ..... B65D 85/48 211/41.14
2016/0257446 A1 * 9/2016 Sperling ..... B65D 19/0026
2020/0247580 A1 * 8/2020 Zuzak ..... B65D 19/385

FOREIGN PATENT DOCUMENTS

DE 102007008457 A1 * 8/2008 ..... B65D 19/12
EP 1571096 A2 * 9/2005 ..... B60P 3/055

* cited by examiner

*Primary Examiner* — Janet M Wilkens
(74) *Attorney, Agent, or Firm* — Martin S. High, P.C.

(57) ABSTRACT

The Gas Cylinder Pallet comprise a top rail, two middle rails, a bottom support, two vertical supports, a top surface plate, two bottom surface plates, a side support, a plurality of edge supports. The vertical support assembly is comprised of a top rail, two vertical supports, two middle rails, and a bottom support. The top surface plate is integrally affixed to two side supports and a plurality of end supports. Two end supports form one-half of an interior structure that supports the top surface plate in the center of the top surface plate. Also integrally affixed to form a base of the gas cylinder pallet is a bottom surface plate. The two vertical supports are integrally affixed to the bottom surface plates on either side of the frame formed by the two vertical supports and the other vertical structures.

2 Claims, 5 Drawing Sheets

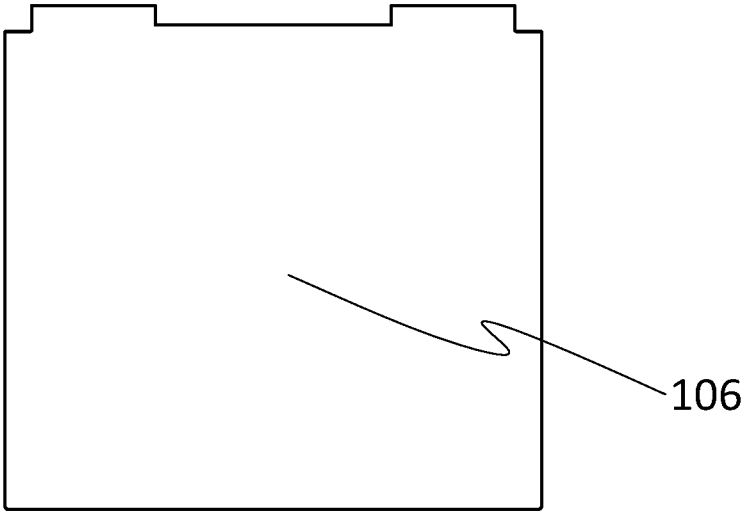
FIG 3A
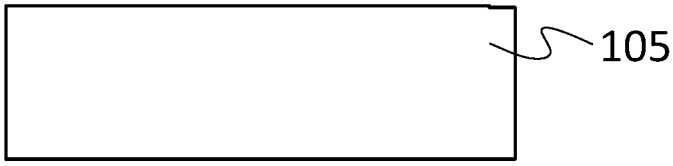
FIG 3B
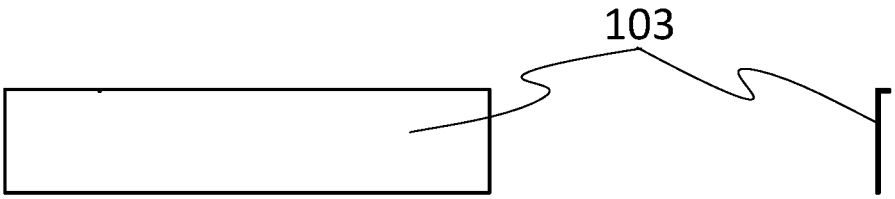
FIG 3C
FIG 3D

GAS CYLINDER PALLET

STATEMENT REGARDING FEDERALLY SPONSORED RESEARCH OR DEVELOPMENT

Not applicable

BACKGROUND OF THE EMBODIMENTS

Field of the Embodiments

The field of the embodiments is gas cylinder pallets.

Background of the Embodiments

High pressure gases for scientific experiments and industrial processes are commonly transported in large steel cylinders. Commonly, for large users of gases these cylinders are packed in 4-packs, 6-packs, 8-packs, and 12-packs of cylinders bundled together. A single cylinder can be handled by hand and moved as needed, but larger packs of cylinders must be moved with forklifts or similar equipment. To transport and move large packs of cylinders, these cylinders must be placed on a stable, secure platform to prevent property and personal injury.

SUMMARY OF THE EMBODIMENTS

The embodiments of the Gas Cylinder Pallet comprise a top rail, two middle rails, a bottom support, two vertical supports, a top surface plate, two bottom surface plates, a side support, a plurality of edge supports.

The vertical support assembly is comprised of a top rail, two vertical supports, two middle rails, and a bottom support. The top rail is integrally affixed to the two vertical supports on either end of the top rail. The two middle rails are integrally affixed to the two vertical supports on either end of each of the middle rails. The bottoms of the two vertical supports are integrally affixed the bottom support. The two vertical supports are integrally affixed to the bottom support on either end of the bottom support.

The top surface plate is integrally affixed to two side supports and a plurality of end supports. Two end supports form one-half of an interior structure that supports the top surface plate in the center of the top surface plate. In addition, interior supports are integrally affixed to the top support surface plate and the end supports form essentially a rectangular shaped structure underneath the top surface plate. Also integrally affixed to form a base of the gas cylinder pallet is a bottom surface plate. The two vertical supports are integrally affixed to the bottom surface plates on either side of the frame formed by the two vertical supports and the other vertical structures. This is in contrast to the welding of the top surface supports to the top of the top surface plate.

There has thus been outlined, rather broadly, the more important features of the embodiments in order that the detailed description thereof that follows may be better understood, and in order that the present contribution to the art may be better appreciated. There are, of course, additional features of the embodiments that will be described hereinafter and which will form the subject matter of the claims appended hereto.

In this respect, before explaining at least one embodiment of the embodiments in detail, it is to be understood that the embodiment is not limited in this application to the details of construction and to the arrangements of the components set forth in the following description or illustrated in the drawings. The embodiment or embodiments are capable of other embodiments and of being practiced and carried out in various ways. Also, it is to be understood that the phraseology and terminology employed herein are for description and should not be regarded as limiting. As such, those skilled in the art will appreciate that the conception, upon which this disclosure is based, may readily be used as a basis for the designing of other structures, methods, and systems for carrying out the several purposes of the embodiments. Additional benefits and advantages of the embodiments will become apparent in those skilled in the art to which the present embodiments relate from the subsequent description of the preferred embodiment and the appended claims, taken in conjunction with the accompanying drawings. It is important, therefore, that the claims be regarded as including such equivalent constructions insofar as they do not depart from the spirit and scope of the embodiments.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the embodiments of the application, which is measured by the claims, nor is it intended to be limiting as to the scope of the embodiments in any way.

BRIEF DESCRIPTION OF THE DRAWINGS

FIG. 3A is a top view of an embodiment of the top surface plate; FIG. 3B is a top view of an embodiment of the bottom surface plate; FIG. 3C is a top view of an embodiment of the bottom support; FIG. 3D is a side view of an embodiment of the bottom support.

DETAILED DESCRIPTION OF THE PREFERRED EMBODIMENTS

Figure 1:
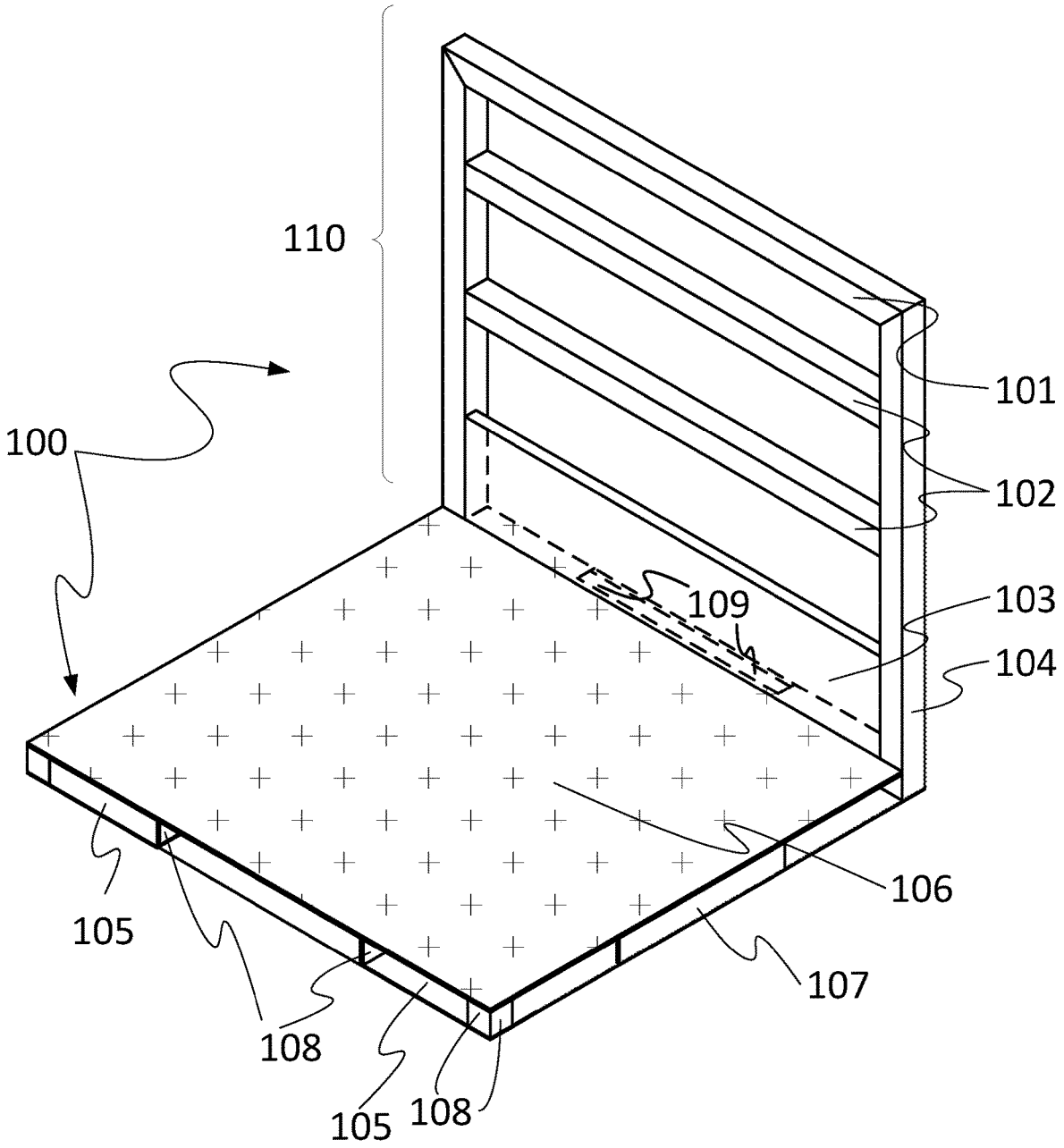
FIG. 1 is a perspective view of an embodiment of the gas cylinder pallet.
Figure 2A:
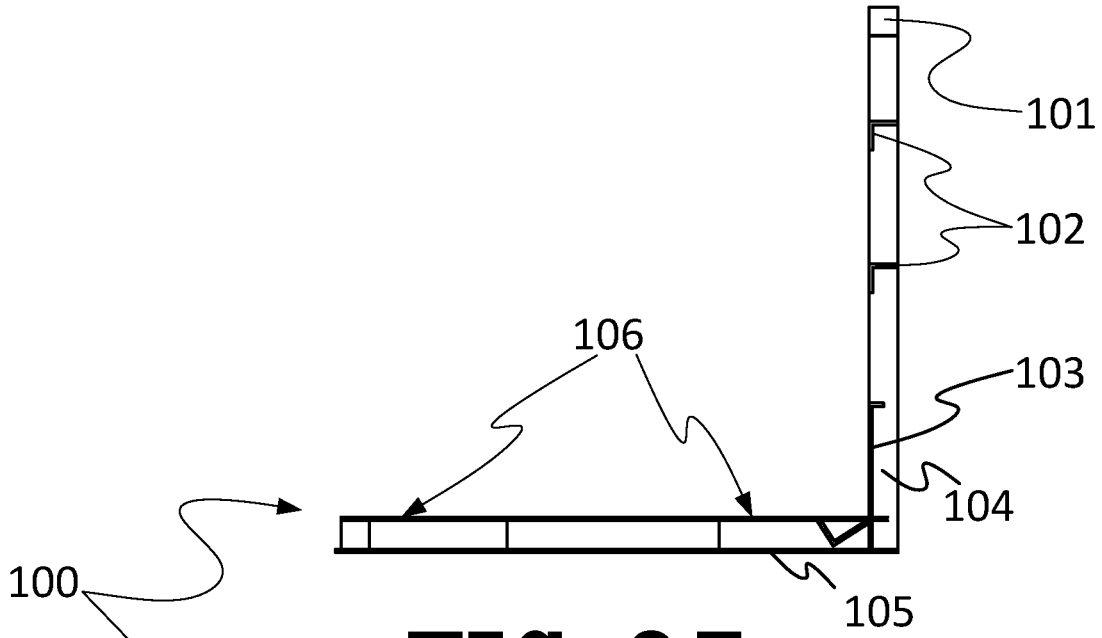
FIG. 2A is a side view of an embodiment of the gas cylinder pallet.
Figure 2B:
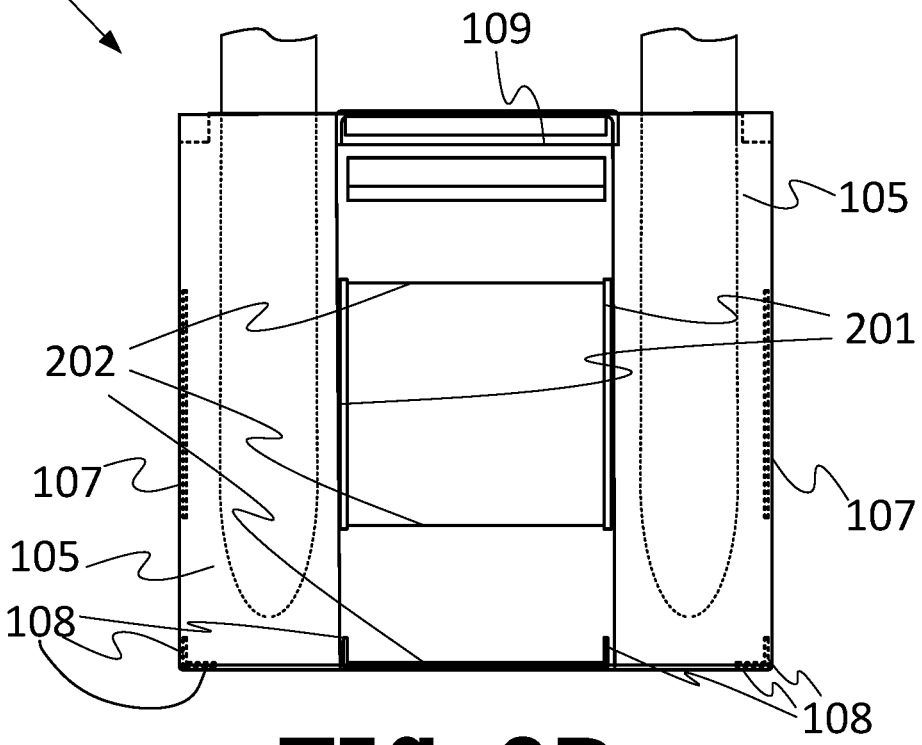
FIG. 2B is a bottom view of an embodiment of the gas cylinder pallet.
Figure 4A:
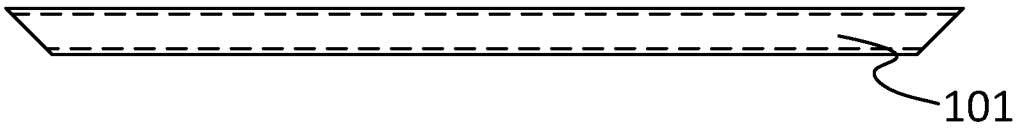
FIG. 4A is a top view of an embodiment of the top rail.
Figure 4B:
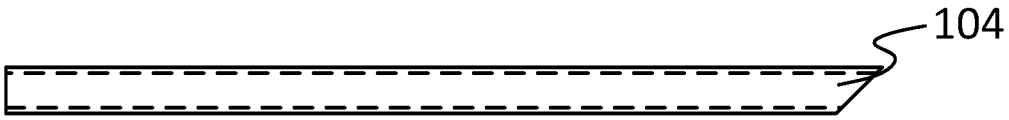
FIG. 4B is a top view of a vertical supports.
Figure 4C:
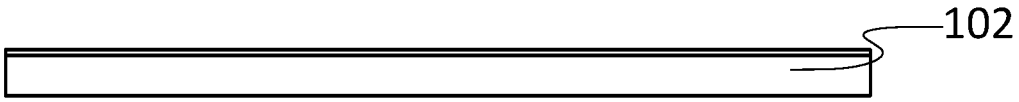
FIG. 4C is a top view of a middle rail.
Figure 5:
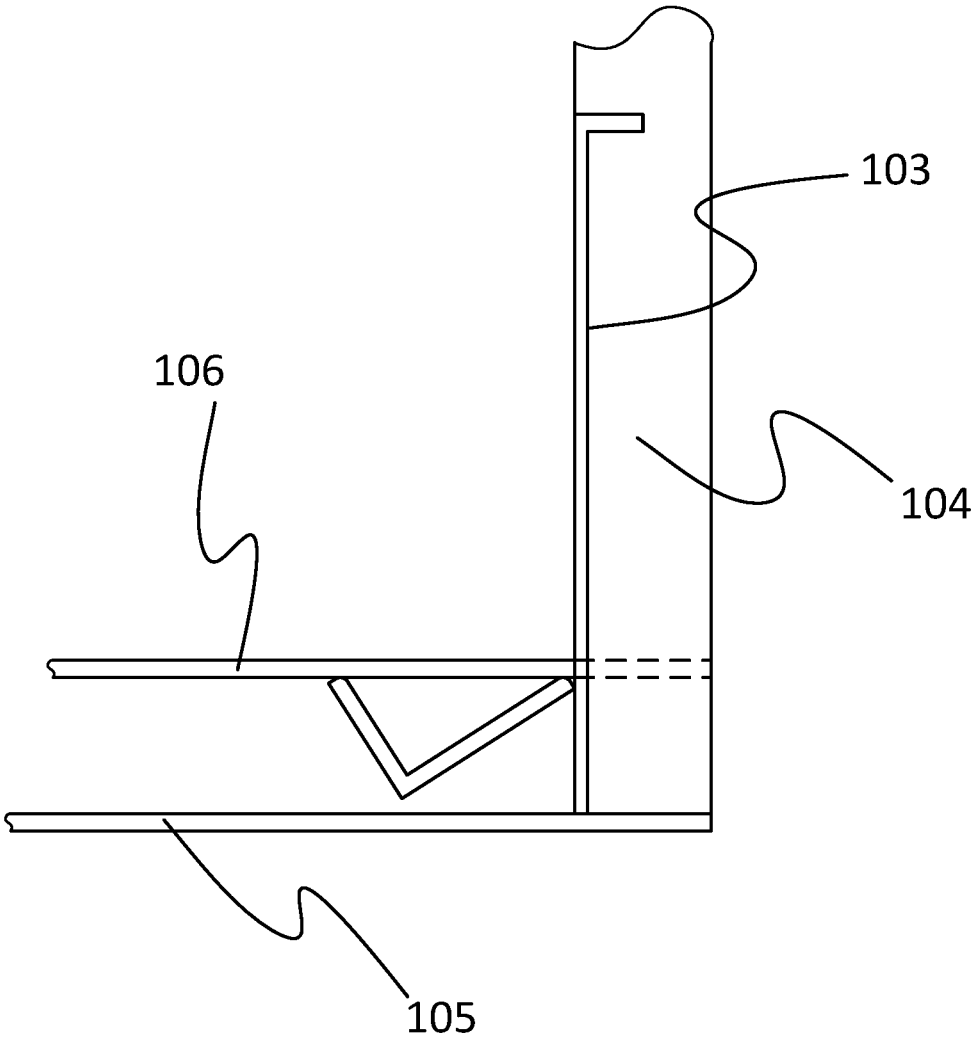
FIG. 5 is a partial view of the welded connection between the vertical support and the bottom surface plate.

Embodiments of the Gas Cylinder Pallet comprise a vertical support assembly 110, a top surface plate 106, two bottom surface plates 105, a side support 107, a plurality of edge supports 108, and a rear support 109.

The vertical support assembly 110 is comprised of a top rail 101, two vertical supports 104, two middle rails 102, and a bottom support 103. The top rail 101 is integrally affixed to the two vertical supports 104 on either end of the top rail 101. The term integrally affixed means to weld, braze, solder, braze, form, fix, or join with an alloy or flux to form an integral union between the two elements. The two middle rails 102 are integrally affixed to the two vertical supports 104 on either end of each of the middle rails 102. The bottoms of the two vertical supports 104 is integrally affixed the bottom support 103. The two vertical supports 104 are integrally affixed to the bottom support on either end of the bottom support 103.

The top surface plate 106 is integrally affixed to two side supports 107 and a plurality of end supports 202. Two end supports 202 form an interior structure that supports the top surface plate 106 in the center of the top surface plate 106. In addition, two interior supports 201 are integrally affixed to the top support surface plate 106 and the end supports 202 that form essentially a square-shaped structure underneath the top surface plate 106. Also integrally affixed to form a base of the gas cylinder pallet 100 are two bottom surface plates 105. The two vertical supports 104 are integrally affixed to the bottom surface plates 105 on either side of the frame formed by the two vertical supports and the other vertical structures. This is in contrast to the usual practice in the prior art of welding the top surface supports to the top of the top surface plate 106. In addition, the vertical support assembly 110 is integrally affixed to the rear support 109.

The bottom surface plates 105 are arranged such that when the embodiments of the gas cylinder pallet are picked up by a forklift the forks of the forklift can be inserted first under the vertical support assembly 110 and then travel underneath the bottom surface plates 105. When the forklift raises the embodiments of the gas cylinder pallet, the weight of the embodiments of the gas cylinder pallet is borne by the top surface plate 106.

What I claimed is:

1. A gas cylinder pallet comprising a vertical support assembly comprised of a top rail, two middle rails, two vertical supports, and a bottom support;

a top surface plate;

a bottom surface plate;

two side supports; and a plurality of edge supports;

wherein two interior supports are integrally affixed to the top surface plate and end supports form essentially a square-shaped structure underneath the top surface plate.

2. A gas cylinder pallet comprising a vertical support assembly comprised of a top rail, two middle rails, two vertical supports, and a bottom support;

a top surface plate;

a bottom surface plate;

two side supports; and a plurality of edge supports;

wherein the two vertical supports are welded to the bottom surface plate and the top surface plate;

wherein the top rail is integrally affixed to the two vertical supports on either end of the top rail;

wherein the two middle rails are integrally affixed to the two vertical supports on either end of each of the middle rails;

wherein bottoms of the two vertical supports are integrally affixed to the bottom support;

wherein the two vertical supports are integrally affixed to the bottom support on either end of the bottom support;

wherein the top surface plate is integrally affixed to the two side supports and a plurality of end supports;

wherein the plurality of end supports form an interior structure that supports the top surface plate in the center of the top surface plate;

wherein two interior supports are integrally affixed to the top surface plate and the end supports form essentially a square-shaped structure underneath the top surface plate.

* * * * *